US009062521B2

(12) United States Patent
Steele

(10) Patent No.: US 9,062,521 B2
(45) Date of Patent: Jun. 23, 2015

(54) HYBRID FLUID LIFT VALVE FOR COMMINGLING GAS PRODUCTION

(75) Inventor: Geoff Steele, Calgary, CA (US)

(73) Assignee: RAISE PRODUCTION INC., Calgary, Alberta (CA)

( * ) Notice: Subject to any disclaimer, the term of this patent is extended or adjusted under 35 U.S.C. 154(b) by 356 days.

(21) Appl. No.: 13/443,680

(22) Filed: Apr. 10, 2012

(65) Prior Publication Data

US 2013/0264066 A1 Oct. 10, 2013

(51) Int. Cl.

| | |
|---|---|
| ***E21B 34/00*** | (2006.01) |
| ***E21B 33/12*** | (2006.01) |
| ***E21B 43/00*** | (2006.01) |
| ***E21B 34/16*** | (2006.01) |
| ***E21B 43/12*** | (2006.01) |
| ***E21B 43/14*** | (2006.01) |

(52) U.S. Cl.

CPC ..... *E21B 33/12* (2013.01); *E21B 34/00* (2013.01); *E21B 43/00* (2013.01); *E21B 34/16* (2013.01); *E21B 43/12* (2013.01); *E21B 43/14* (2013.01)

(58) Field of Classification Search

USPC ..... 166/369, 191, 316, 306, 313, 373, 347, 166/387, 324, 334.1

See application file for complete search history.

(56) References Cited

U.S. PATENT DOCUMENTS

| | | | | |
|---|---|---|---|---|
| 2,064,272 | A | 7/1935 | Scott | |
| 2,618,339 | A * | 11/1952 | Glover | 166/114 |
| 3,193,016 | A | 7/1965 | Knox | |
| 3,371,717 | A * | 3/1968 | Chenoweth | 166/147 |
| 3,583,481 | A | 6/1971 | Vernotzy | |
| 3,653,439 | A | 4/1972 | Kisling, III | |
| 4,258,793 | A | 3/1981 | McGraw et al. | |
| 4,291,723 | A | 9/1981 | Belmgraben et al. | |
| 4,354,554 | A | 10/1982 | Calhoun et al. | |
| RE31,842 | E | 3/1985 | Weitz | |
| 4,655,292 | A * | 4/1987 | Halbardier | 166/387 |
| 4,832,126 | A | 5/1989 | Roche | |
| 2002/0017384 | A1 | 2/2002 | Ostocke et al. | |
| 2004/0084190 | A1 | 5/2004 | Hill et al. | |
| 2006/0011354 | A1 | 1/2006 | Logiudice et al. | |
| 2006/0278399 | A1* | 12/2006 | Dwivedi et al. | 166/375 |
| 2008/0164035 | A1 | 7/2008 | Bolding et al. | |
| 2010/0230109 | A1* | 9/2010 | Lake et al. | 166/332.8 |
| 2011/0073295 | A1* | 3/2011 | Steele et al. | 166/53 |

FOREIGN PATENT DOCUMENTS

| | | |
|---|---|---|
| EP | 1000220 | 5/2000 |

* cited by examiner

*Primary Examiner* — David Andrews
*Assistant Examiner* — Taras P Bemko
(74) *Attorney, Agent, or Firm* — Bennett Jones LLP

(57) ABSTRACT

A method and apparatus for commingling sweet gas and sour gas production in a gas well having an upper sweet zone and a lower sour zone. The apparatus comprises a commingling valve which prevents cross flow of sour fluids into the sweet zone or casing annulus.

15 Claims, 8 Drawing Sheets

HYBRID FLUID LIFT VALVE FOR COMMINGLING GAS PRODUCTION

FIELD OF THE INVENTION

The present invention is directed to a valve for use in production from gas wells with separate sweet and sour zones.

BACKGROUND

Sour gas wells are completed with a packer in place to isolate the sour production from the annular space between the well casing inside diameter and the outside diameter of the production tubing. The packer prevents sour gas from entering the annulus and corroding the casing string, which is the barrier between the wellbore and any adjacent ground water or aquifer. In many instances, these sour producing zones are completed with uphole zones producing sweet gas from above the packer isolation inside the annular space.

Wells which are completed with both up-hole sweet annular production and lower packer-isolated sour production are produced conventionally until the sour producing well is depleted. At this stage, a conventional service rig is employed on the well and the tubing is removed, packer unset and removed. The lower sour zone is abandoned and the well is re-completed for production only from the up-hole sweet zone. Due to the nature of the sour gas production the tubing in the wells is often brittle; debris present on top of the lower packer and makes pulling the existing completion challenging and often prohibitively expensive.

Co-production of sweet gas through the annulus and sour gas through the tubing string can create other issues. Due to the significantly larger cross sectional area of the casing annulus compared to the tubing inside diameter, a larger flow rate is necessary in the annulus against comparable flowing surface pressures to maintain production above critical rates. Inevitably, a technical limit (critical production rate) is reached in the annulus before the tubing, at which point liquids begin to drop out of the gas flow and accumulate in the annulus. Liquid accumulation results in a static pressure on the annular producing zones which eventually causes production to cease from the annular zone.

SUMMARY OF THE INVENTION

In one aspect, the invention comprises a downhole commingling valve assembly for insertion into production tubing, comprising:

(a) an outer housing and an inner production tube disposed concentrically within the housing, defining an annular space therebetween, wherein the annular space comprises a refined hydraulic zone, and an unrefined production zone;

(b) a valve assembly disposed within the annular space and comprising:

i. a valve seat and an activation mandrel moveable between a first closed position engaging the valve seat, and an open position providing fluid communication to the inner production tube from the unrefined production zone;

ii. a sealed pneumatic chamber bearing on one side of a moveable activation piston;

iii. a sealed refined hydraulic chamber bearing on the opposing side of the activation piston, iv, a bellows assembly comprising a flexibly resilient bellows affixed relative to the housing at one end, and affixed to the activation mandrel at an opposite end, wherein the bellows separates the refined hydraulic zone and the unrefined production zone, and wherein the bellows may be compressed or stretched by movement of the activation mandrel; and v. an equalization chamber open to the exterior of the outer housing, separated from the sealed hydraulic chamber by a flexible pressure transmitting membrane; such that the pressure in the refined hydraulic zone is equal to the pressure outside the housing.

In one embodiment, the valve assembly further comprises a check valve permitting flow into the inner production tube and preventing reverse flow.

In another aspect, the invention may comprise a method of producing a gas well having a well casing and a production tubing concentrically disposed in the well case, said well having lower producing zone open to the production tubing and an upper producing zone isolated from the lower producing zone and open to the casing annulus, comprising:

(a) perforating the production tubing adjacent the upper producing zone;

(b) landing a commingling valve within the production tubing adjacent the perforations with packers above and below the perforations, wherein the commingling valve permits passage of production fluids from the lower producing zone through the production tubing;

(c) permitting passage of production fluids from the upper producing zone into the production tubing when fluid pressure exceeds an activation pressure necessary to open the commingling valve; and (d) isolating the upper producing zone from the production tubing when the upper producing zone pressure is below the activation pressure.

In another aspect, the invention may comprise a completion string for a gas well having a well casing and a production tubing concentrically disposed in the well case, said well having lower producing zone open to the production tubing and an upper producing zone isolated from the lower producing zone and open to the casing annulus, comprising:

(a) a commingling valve assembly;

(b) a packer positioned above and below the commingling valve;

(c) means for landing the string into the production tubing; and (d) an optional integral check valve.

In another aspect, the invention may comprise the use of a commingling valve or a completion string as described or claimed herein, in a commingling method of producing a gas well having a well casing and a production tubing concentrically disposed in the well case, said well having lower producing zone open to the production tubing and an upper producing zone isolated from the lower producing zone and open to the casing annulus.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The invention relates to a valve for commingling sweet and sour gas production from different zones in a gas well. When describing the present invention, all terms not defined herein have their common art-recognized meanings. To the extent that the following description is of a specific embodiment or a particular use of the invention, it is intended to be illustrative only, and not limiting of the claimed invention.

The apparatus of the present invention is designed to facilitate commingling of up-hole sweet and lower packer isolated sour production effluents in the tubing string for production to surface through a common tubing string. A commingling valve permits one way flow of fluids and gases from the annulus into the production tubing while preventing cross-flow of the lower packer isolated sour zone into the annulus.

Figure 1:
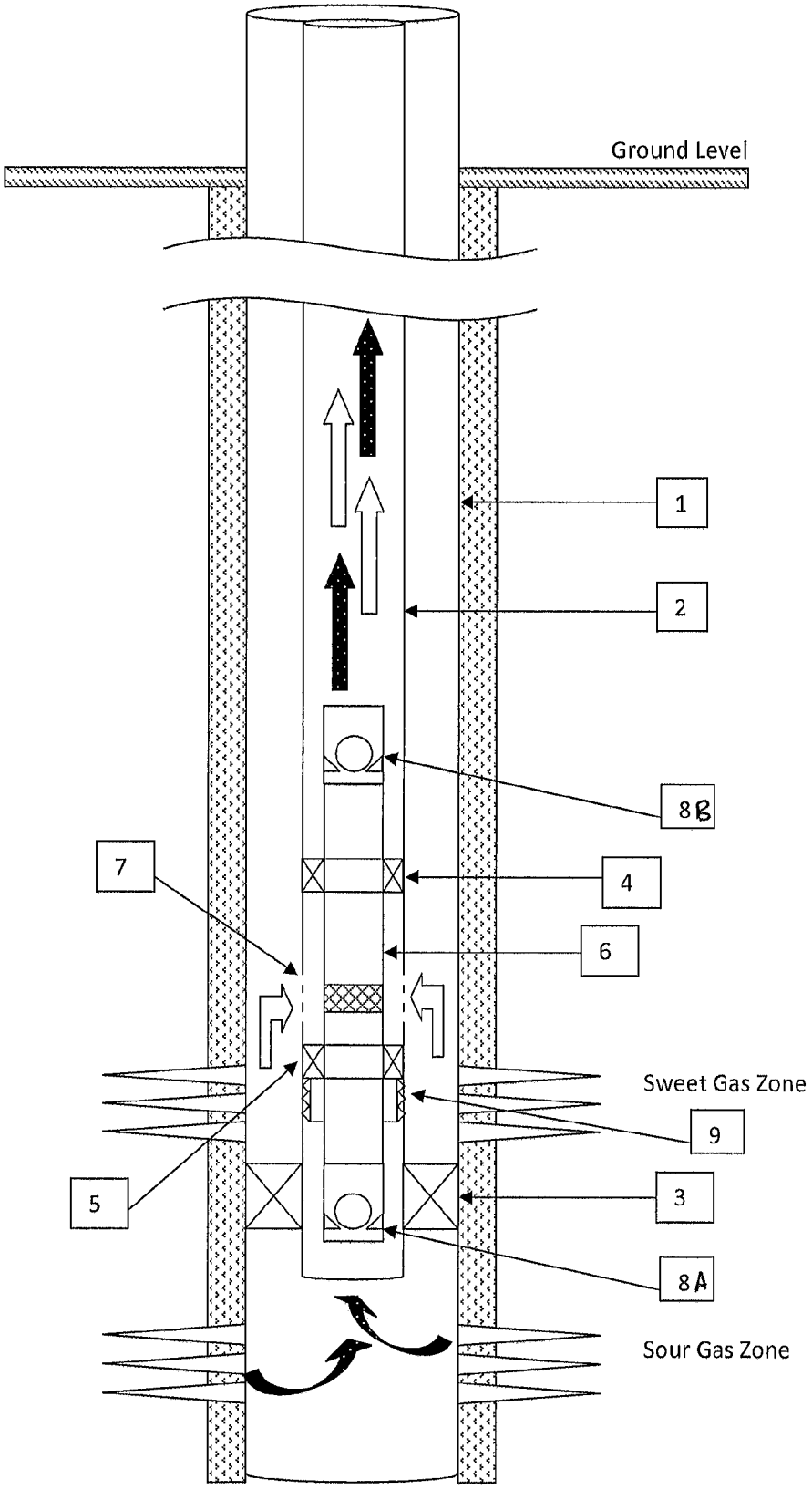
FIG. 1 is a schematic representation of a wellbore with multiple producing zones, sectioned vertically along its length and depicting the commingling valve thru tubing completion landed across communication holes through the wall of the production tubing.
Figure 2A:
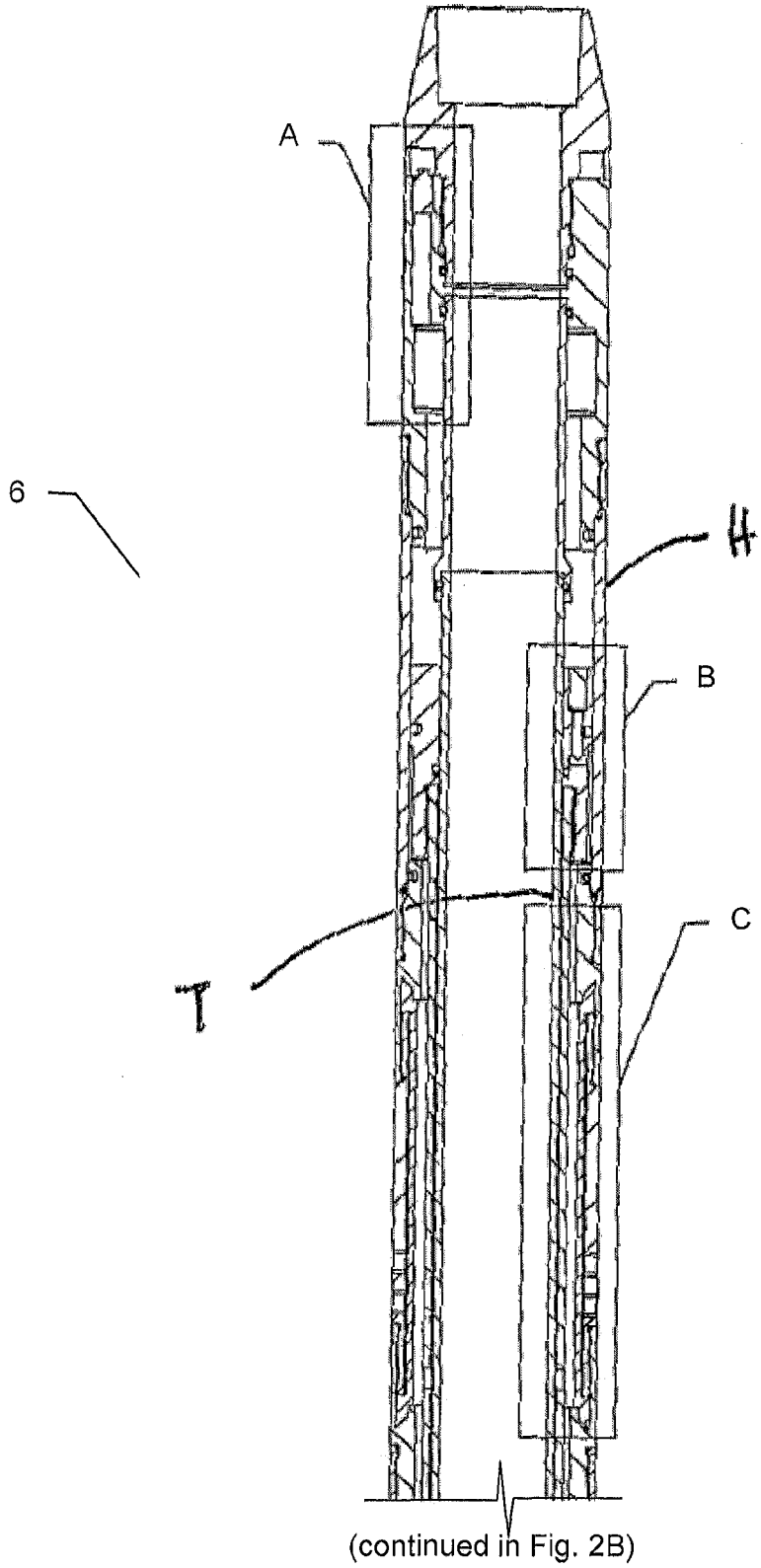
FIGS. 2A, 2B, and 2C collectively is a schematic representation of the upper, middle, and lower segments, respectively, the commingling valve device sectioned along its length to reveal all of the working components.
Figure 2B:
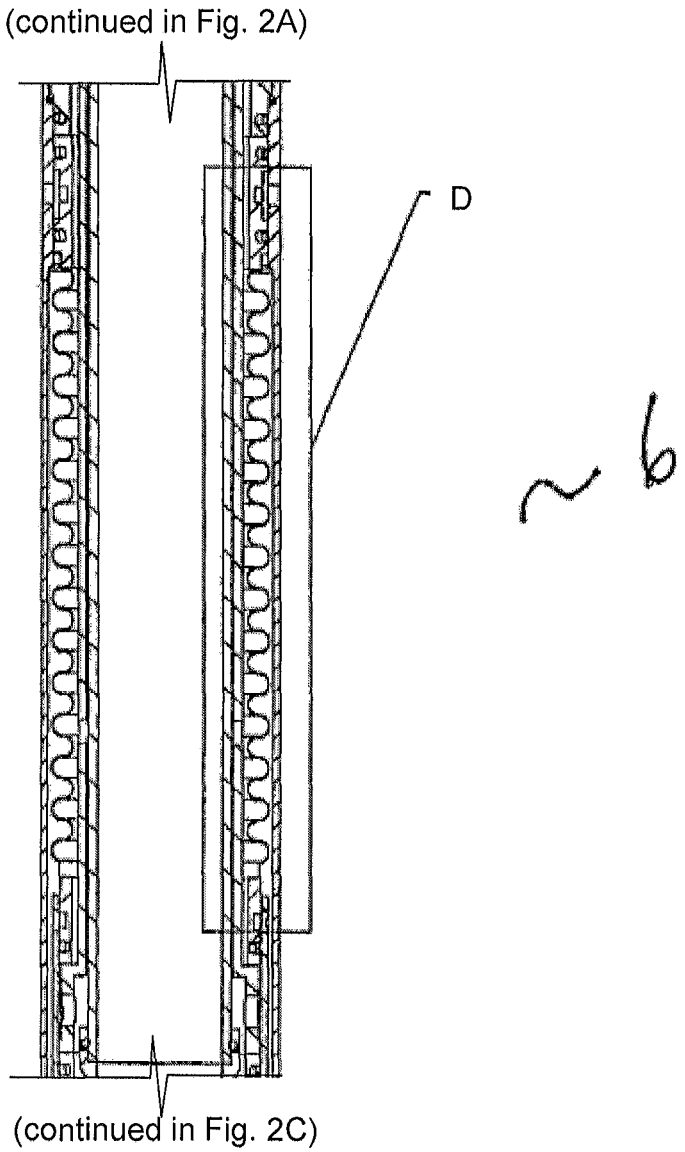
Figure 2C:
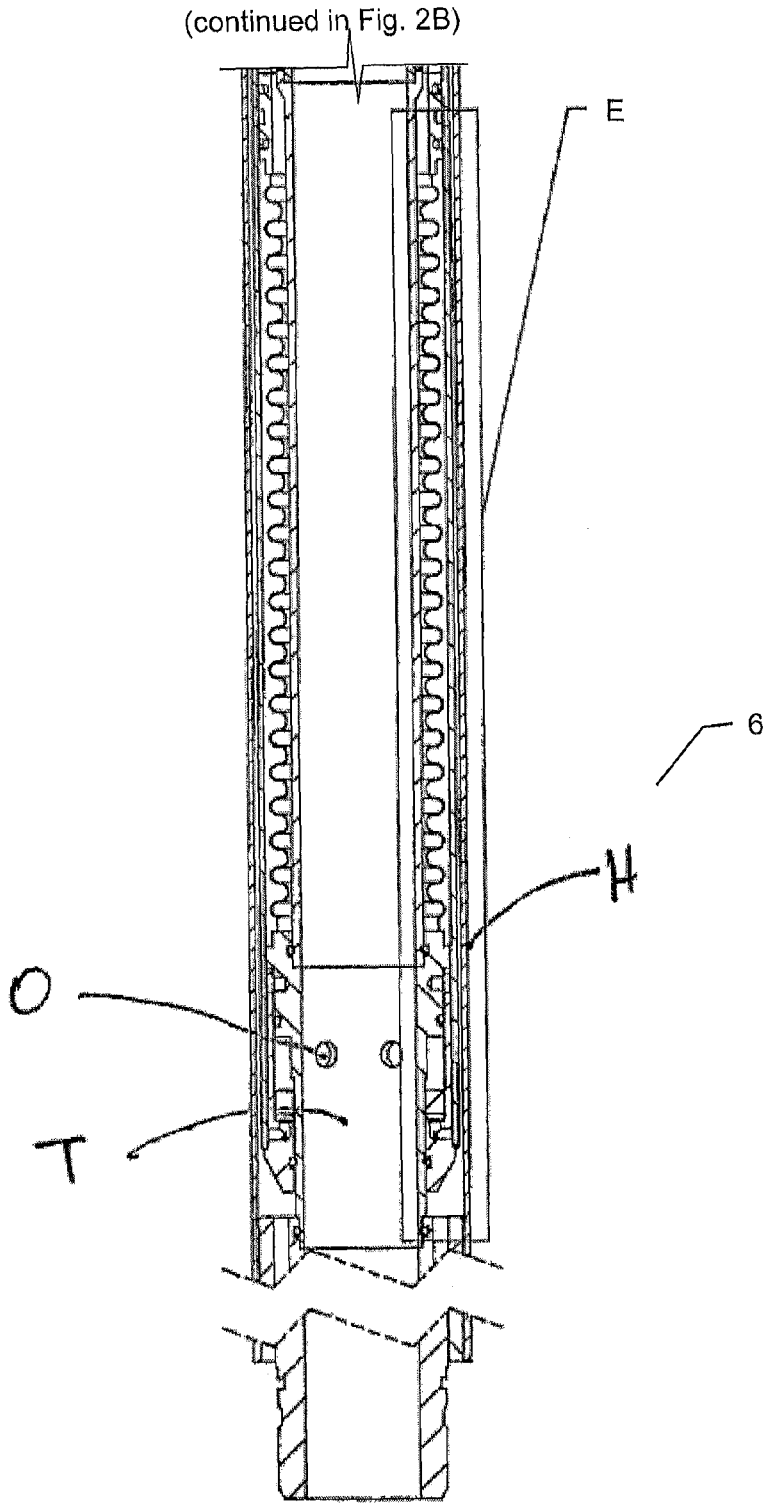
Figure 3:
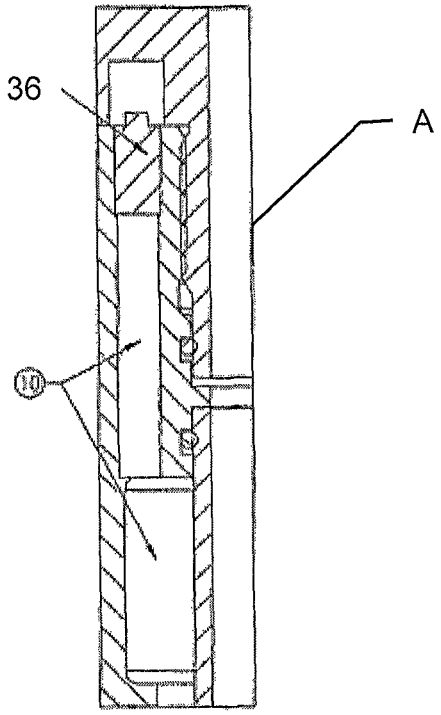
FIG. 3 is a detailed view of area A shown in FIG. 2A, showing the pneumatic chamber and one way filling valve.
Figure 4:
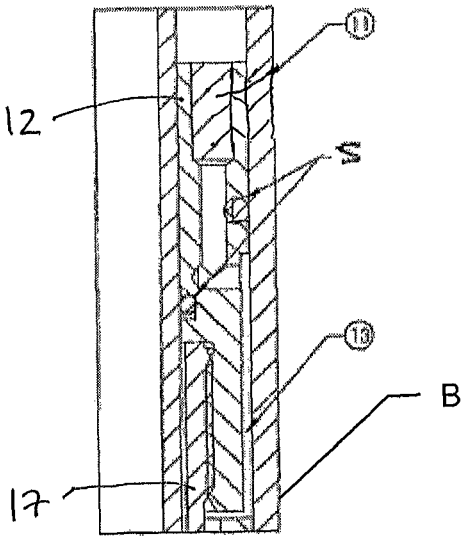
FIG. 4 is a detailed view of area B of FIG. 2A, showing the activation piston equipped with main seals and a hydraulic oil filling valve for charging the refined hydraulic chamber with hydraulic oil.
Figure 5:
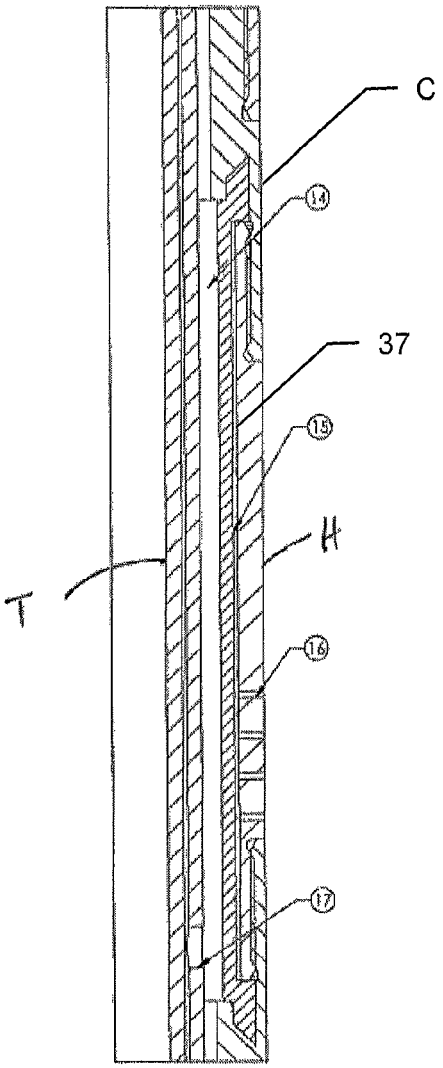
FIG. 5 is a detailed view of area C shown in FIG. 2A, showing the resilient member (bladder) chamber occupied on the inside by refined hydraulic oil and on the outside by produced fluid from the annulus.
Figure 6:
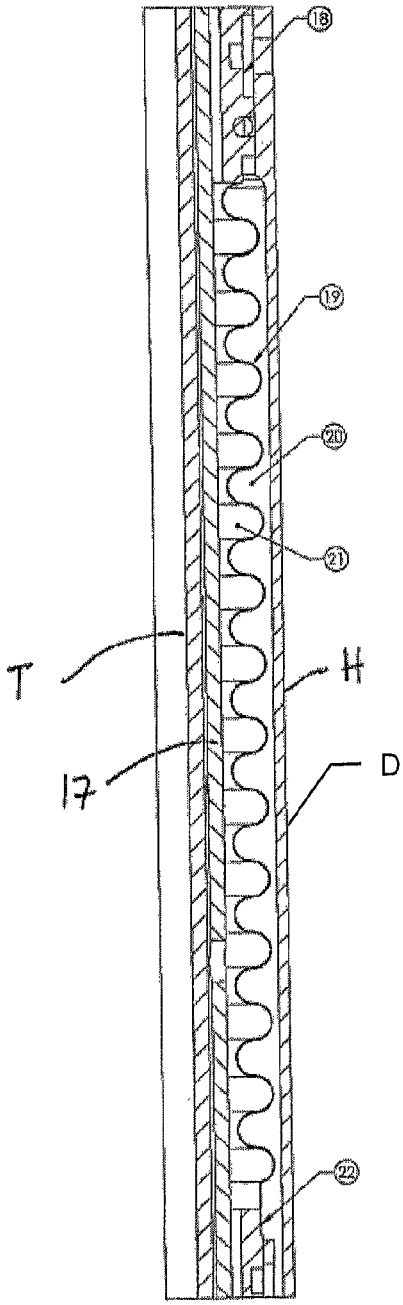
FIG. 6 is a detailed view of area D shown in FIG. 2B, showing the upper mechanical bellows and the chamber and fluids immediately adjacent to the bellows.
Figure 7:
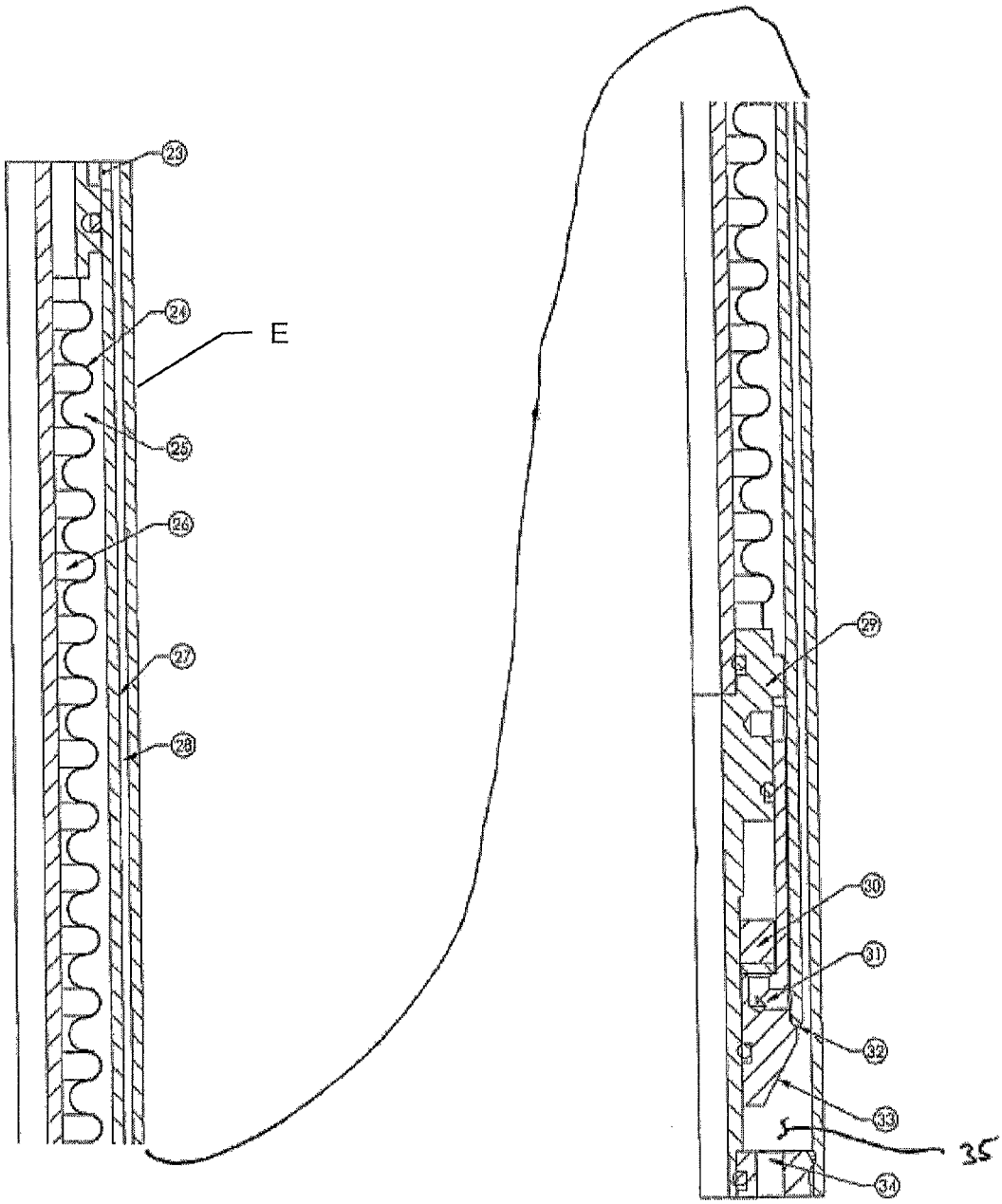
FIG. 7 is a detailed section view area E shown in FIG. 2C, showing the lower mechanical bellows, lower activation mandrel, valve seat and redundant check valve. Also depicted in this detailed section view are the exit ports on the top end of the filter which feeds into the chamber immediately adjacent the valve seat.
Figure 8:
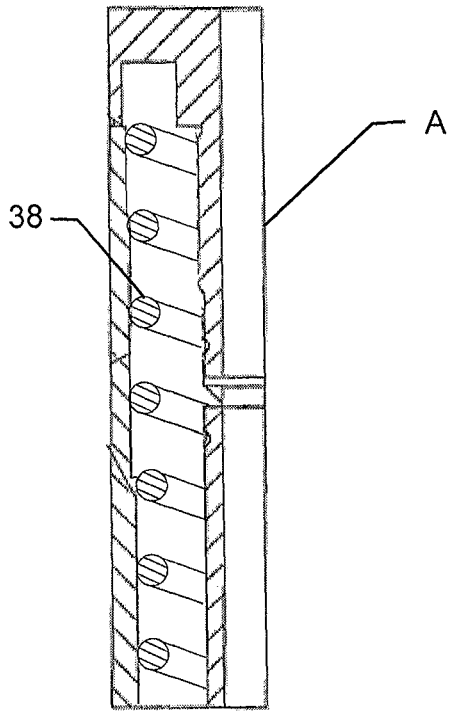
FIG. 8 is a detailed view of another embodiment of the commingling valve device having a coil spring, in an area corresponding to area A of the embodiment shown in FIG. 2A.
Figure 9:
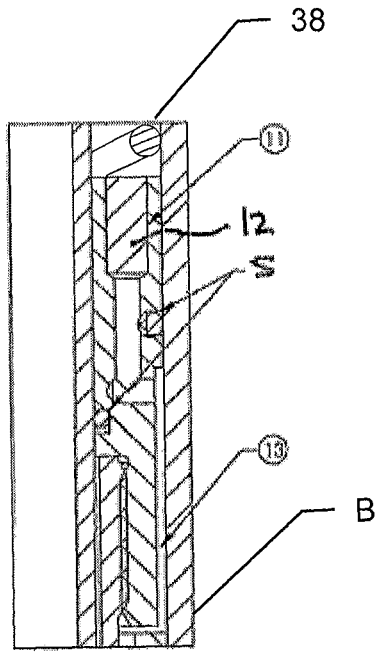
FIG. 9 is a detailed view of another embodiment of the commingling valve device having a coil spring, in an area corresponding to area B of the embodiment shown FIG. 2A.

As shown in FIG. 1, a producing gas well comprises a casing string (1) and a production tubing string (2). A packer (3) provides a seal between the tubing outside diameter and the casing inside diameter, between the lower sour zone and the upper sweet zone. The packer (3) prevents cross-flow of produced fluids and gas between the sweet and sour zones. In this schematic the direction of the flow is represented by two separate arrows (black for sour production and white for sweet production). It should be noted that these two flows are segregated before entering the tubing string and this segregation is accomplished by the packer (3). The normal production workflow of a well of this type is all of the sour gas production flowing up the production tubing string (2) through the packer bore to surface and the up-hole sweet production flowing up the casing annulus (separate but parallel) to the sour tubing production.

In the present wellbore configuration this scenario continues until such a point as the tubing sour zone is depleted, abandoned or suspended and the well is subsequently re-completed for dedicated production from the up-hole, sweet producing zones. This type of re-completion can be prohibitively expensive since the tubing must be moved up-hole to allow flow from the sweet zones up the tubing string. This will often include unsetting the packer (3) and removing it and the existing production tubing string (2) from the wellbore, and then suspending or abandoning the sour producing zone while re-completing for sweet up-hole production up the production tubing string (2).

The method and apparatus of the present invention provide for an alternate means of production, facilitating commingled flow of sweet and sour production up the production tubing string (2) without recompletion of the wellbore. The apparatus comprises a passive device which responds to real and current downhole conditions, and does not require external controls or activators.

Therefore, in one aspect, the invention comprises a method of commingling sweet and sour producing zones up a single production tubing string (2) to surface utilizing a through tubing completion landed at the commingling junction. This is accomplished with a commingling valve concentrically disposed inside the production tubing string (2) and passively controls the commingling process in the production tubing string (2).

In general terms, in another aspect, the apparatus of the present invention comprises a commingling valve, which opens in response to pressure in the casing annulus, to permit gas flow from the annulus into the production tubing string (2).

In one embodiment, the valve is included in a completion tool string which may comprise (from bottom up):

- an optional integral check valve (8A)
- Small tubing pup joints (in one embodiment 1.315" (33.3-mm))
- tubing anchor (9) and packer (5)
- the commingling valve (6)
- packer (4) and
- another optional integral check valve (8B)

This tool string is landed across previously placed communication holes or perforations (7) in the production tubing string (2) by conventional wireline or coiled tubing techniques. The compression set packers (4, 5) isolate and provide for a communication path to the commingling valve (6). Using this through tubing completion tool string, all of the produced liquids and gas from the annulus pass through the holes (7) placed in the production tubing string (2) wall and from there, pass through the commingling valve (6) and into the production tubing string (2) to surface. Sour gas moves from perforations at the sand-face in the lower producing zone, through the lower check valve (8A), through lower tubing anchor (9) and packer (5) bores, through the commingling valve (6) bore and upper packer (4), and finally through the upper check valve (8B) into the production tubing string (2). Thus, production from the two separate zones may be commingled and produced to surface. Suitable anchor and packer configurations are described in co-owned U.S. Pat. No. 7,347,273 B2, the entire contents of which are incorporated herein by reference (where permitted).

Alternate means exist of completing this production workflow including, but not limited to a locking and sealing mandrel assembly (as is well known in the art) to engage and seal in an existing selective profile nipple integral to the production tubing string (2). This would replace the lower anchor (9) and packer (5) depicted in FIG. 1. This completion is possible if a selective profile nipple exists and is easily accessible in the wellbore relative to the location of the communication ports through the tubing wall. In another alternative, the tool string may be landed across an open sliding sleeve providing communication through the wall of the production tubing string (2) from the annulus. All of the elements tool string may be designed to pass through the largest standard selective profile nipple size in order to easily facilitate landing said tool string across an existing sliding sleeve (equipped with profile nipple) or below an existing profile nipple in the event that complex wellbore geometry is encountered.

In general terms, the commingling valve (6) comprises an outer housing (H), and an inner production tube (T). The valve mechanism is disposed within the annular space between the housing (H) and the inner production tube (T). The valve mechanism comprises a biasing mechanism for pre-loading the valve into a closed position. In one embodiment, the biasing mechanism comprises a fixed mechanical pre-load, and an adjustable pneumatic pre-load. The commingling valve preferably comprises redundant check valve assemblies for safety purposes to prevent migration of sour gas from the production tubing string (2) and into the casing annulus.

The adjustable pre-load may comprise an air spring or a coil spring (38). In one embodiment, the adjustable pre-load comprises a pneumatic pressure chamber (10), which may be charged through a one-way valve (36) in the chamber wall. The pressure inside this chamber is customizable for individual well applications and is preferably charged with an inert gas such as nitrogen.

In one embodiment, the valve actuation assembly is entirely isolated from the wellbore by suitable seals and a hydraulic system, to prevent well effluents from contaminating the components and prevent free movement. The pneumatic chamber (10) bears on an activation piston (12), which may be any sealed with any suitable seal such as O-rings. The piston (12) is equipped with a valve (11) for filling the hydraulic chamber (14) of the tool with refined hydraulic oil.

The activation piston bears on the upper end (13) of a hydraulic chamber (14). The barrier between the refined and unrefined environments at the tool top end is a flexible membrane (15) which transmits pressure from the annulus of the well to the hydraulic chamber (14). The outside of the flexible membrane (15) and the inside of the outer housing (H) define therebetween an equalization chamber (37). The static pressure of the annulus is communicated to equalization chamber (37) and hence the outside of the resilient flexible membrane (15) through a plurality of small openings (16) in the outer housing (H). An upper activation mandrel (17) is slidingly disposed within the housing and may also define a port to provide fluid pressure communication between the small annular spaces which make up the hydraulic chamber (14).

The region below and adjacent to the flexible membrane (15) section is the upper bellows section, which continues the isolation of the hydraulic chamber (14) from the fluid/pressure of the casing annulus. The upper bellows (19) is affixed to a fixed support member (18) at one end, and at the other end comprises a lower support (22) which is affixed to the upper activation mandrel (17). On the outside of the upper bellows is a small annular space (20) which is in fluid communication with the casing annulus, and filled with unrefined production fluids.

The upper activation mandrel (17) slides within the inside (21) of the upper mechanical bellows (19), in a continuation of the hydraulic chamber (14), which one skilled in the art will appreciate is at pressure equilibrium with the casing annulus.

The lower support (22) of the upper bellows (19) is affixed to the upper end of a lower activation mandrel (27). As such, the lower activation mandrel (27) itself is indirectly affixed to the lower end of the upper activation mandrel (17). The lower activation mandrel (27) is further affixed to an upper end support (23) of the lower bellows (24). Accordingly, the upper and lower activation mandrels (17, 27) and the lower support (22) of the upper bellows, and the upper support (23) of the lower bellows (24), all move together as a unit.

The bellows (19, 24) themselves comprise a flexibly resilient material such as a thin metal sheet. Sliding movement of the activation mandrels will compress one bellows, while stretching the other bellows. The primary function of the upper and lower bellows is two-fold: providing a pre-load on the activation mandrels (17, 27) while maintaining isolation of the internal refined hydraulic chamber (14) from the unrefined produced fluids in the casing annulus.

The inside volume of the lower bellows is occupied by refined hydraulic oil (26) and the outside (25) of the lower bellows is occupied by unrefined produced liquid at a pressure equal to the last activation cycle. The lower activation mandrel (27) is immersed in the unrefined produced liquid. This space is in fluid communication with the casing annulus though the thin annular space inside the lower activation mandrel (27) and the valve chamber (35). Fluid enters the valve chamber (35) through a filter (34) at the bottom end of the tool. The filtration device utilized in this assembly may comprise any suitable filtration media.

Once the tool has been landed in position and in operation, the commingling valve (6) responds to casing annulus pressure to open and close. Once the casing annulus pressure rises above the pneumatic chamber (10) pressure, and any other preload on the activation mechanism, the piston (12) translates upward via the fluid pressure communication across the flexible membrane (15), and consequently compressing the upper bellows and stretching the lower bellows. This movement results in the activation mandrel (27) moving off of the valve seat (33) and opening fluid communication between the casing annulus and valve chamber (35) and the tubing through openings (O) in the inner production tube (T). On the open path from the casing annulus through inner production tube (T) to production tubing string (2), the annulus well effluents pass through the redundant check valve (30). In one embodiment, this valve (30) is biased downwardly by a light spring (not shown) which closes the valve (30) once the pressures equalize between the casing annulus and the inner production tube (T). In the event of a failure of the commingling valve (6) or the activation mandrel, this redundant check valve (30) checks flow and prevents crossflow of the sour produced effluents across the valve (30) and into the casing annulus. Once the annular pressure drops below the preload force of the commingling valve (6), the lower activation mandrel moves downwardly to seal against the valve seat (33).

In one embodiment, the pneumatic pressure chamber can be charged to a very high pressure before use in the field, and can then be adjusted to a desired pressure for the particular downhole conditions it will encounter. The construction of the upper and lower bellows provides a fixed baseline preload, while the pneumatic chamber system provides a variable customizable preload.

The tool requires suitable internal sealing to maintain isolation between the refined and unrefined fluids in which the tool must operate. Other design considerations include the efficient use of the external wall area and material selection for the cohabitation of all working mechanical components, through bore flow area equivalent to the common adjacent tubing members, and a tool strength through the body which exceeds that of adjacent tubing members for efficient retrieving and/or fishing operations should they be necessary. In one embodiment, the valve (6) inside diameter is open to suitable production flow and passage of tool strings, while the tool body maintains a strength sufficiently large enough to exceed the strength of adjacent API tubing members.

What is claimed is:

1. A downhole commingling valve assembly for insertion inside a production tubing, the assembly comprising:

(a) a valve body having a longitudinal axis comprising:

i. an outer housing; and ii. an inner production tube disposed concentrically within the housing, defining an annular space therebetween;

(b) a valve mechanism disposed within the annular space and defining with the valve body, within the annular space, a sealed hydraulic chamber and an unrefined production zone, the valve mechanism comprising:

i. a valve seat and an activation mandrel moveable between a closed position engaging the valve seat to prevent fluid communication to the inner production tube from the unrefined production zone, and an open position disengaged from the valve seat to allow fluid communication to the inner production tube from the unrefined production zone;

ii. a moveable activation piston which actuates the activation mandrel, biased towards maintaining the activation mandrel in the closed position, and responsive to an increase in fluid pressure within the sealed hydraulic chamber to actuate the activation mandrel to the open position;

iii. a bellows assembly comprising a flexibly resilient bellows affixed to the valve body, at one end, and affixed to the activation mandrel at an opposite end, wherein the bellows separates the sealed hydraulic chamber and the unrefined production zone, and wherein the bellows may be compressed or stretched by movement of the activation mandrel; and iv. an equalization chamber open to an exterior of the outer housing, separated from the sealed hydraulic chamber by an axially fixed flexible pressure transmitting membrane such that the flexible pressure transmitting membrane is displaced transversely to communicate fluid pressure from the exterior of the housing to the sealed hydraulic chamber.

2. The valve assembly of claim 1 wherein the bellows assembly comprises an upper bellows and a lower bellows, wherein a lower end of the upper bellows and an upper end of the lower bellows engages the activation mandrel.

3. The valve assembly of claim 2 wherein the activation mandrel comprises an upper activation mandrel disposed within the sealed hydraulic chamber, and a lower activation mandrel disposed within the unrefined production zone.

4. The valve assembly of claim 2 wherein the bellows assembly comprises a corrugated metal sheet.

5. The valve assembly of claim 1 wherein the activation mandrel comprises an upper activation mandrel disposed within the sealed hydraulic chamber, and a lower activation mandrel disposed within the unrefined production zone.

6. The valve assembly of claim 1 further comprising a check valve permitting flow into the inner production tube from the unrefined production zone and preventing flow from the inner production tube into the unrefined production zone.

7. The valve assembly of claim 1 wherein the activation piston is biased by an air spring or a coil spring.

8. The valve assembly of claim 7 wherein the air spring comprises a nitrogen chamber and a fill valve.

9. The valve assembly of claim 1 wherein the bellows assembly comprises a corrugated metal sheet.

10. A completion string for a gas well having a well casing and a production tubing concentrically disposed in the well casing and defining a casing annulus therebetween, said well having a lower producing zone open to the production tubing and an upper producing zone isolated from the lower producing zone and open to the casing annulus, the string comprising:

(a) a commingling valve disposed inside the production tubing adjacent the upper producing zone, wherein the commingling valve permits passage of production fluids from the lower producing zone through the production tubing, wherein the commingling valve further allows the passage of production fluids from the upper producing zone into the production tubing when open, said commingling valve comprising an equalization chamber open to the upper producing zone, separated from a sealed hydraulic chamber by an axially fixed flexible pressure transmitting membrane, such that the flexible pressure transmitting membrane is displaced transversely to communicate fluid pressure from the upper producing zone to the sealed hydraulic chamber, and wherein pressure in the sealed hydraulic chamber results in an activation mandrel to move to an open position, thereby opening a valve to permit flow of production fluid from the upper producing zone into the production tubing;

(b) an upper packer for sealing the string to the production tubing above the valve assembly and a lower packer for sealing the string to the production tubing below the valve assembly; and (c) means for landing the string inside the production tubing.

11. The completion string of claim 10 wherein the means for landing the string comprises an anchor.

12. The completion string of claim 10 wherein the means for landing the string comprises a locking and sealing mandrel assembly to engage and seal in an existing selective profile nipple integral to the production tubing.

13. The completion string of claim 10 further comprising an integral check valve permitting flow into the valve assembly from the production tubing below the lower packer and preventing reverse flow from the valve assembly into the production tubing below the lower packer.

14. The completion string of claim 10 further comprising an integral check valve permitting flow into the production tubing above the upper packer from the valve assembly and preventing reverse flow from the production tubing above the upper packer into the valve assembly.

15. A method of producing a gas well having a well casing and a production tubing concentrically disposed in the well casing and defining a casing annulus therebetween, said well having a lower producing zone open to the production tubing and an upper producing zone isolated from the lower producing zone and open to the casing annulus, comprising:

(a) providing perforations in the production tubing adjacent the upper producing zone;

(b) landing a commingling valve inside the production tubing adjacent the perforations with an upper packer sealing the commingling valve to the production tubing above the perforations and a lower packer sealing the commingling valve to the production tubing below the perforations, wherein the commingling valve permits passage of production fluids from the lower producing zone through the production tubing;

(c) permitting passage of production fluids from the upper producing zone into the production tubing above the upper packer by allowing the commingling valve to open in response to fluid pressure inside the production tubing between the packers exceeding an activation pressure necessary to open the commingling valve; and (d) isolating the upper producing zone from the production tubing by allowing the commingling valve to close in response to fluid pressure in the production tubing between the packers decreasing below the activation pressure.

* * * * *